US006075962A

United States Patent [19]

Seguchi et al.

[11] Patent Number: 6,075,962

[45] Date of Patent: Jun. 13, 2000

[54] TONER CARTRIDGE SEALED BY EXPANDABLE HOT-MELT ELASTIC ADHESIVE

[75] Inventors: Kazuhiro Seguchi, Fukuoka; Noboru Miyahara, Saga, both of Japan

[73] Assignee: Matsushita Electric Industrial Co., Ltd., Osaka, Japan

[21] Appl. No.: 09/243,823

[22] Filed: Feb. 3, 1999

[30] Foreign Application Priority Data

Mar. 11, 1998 [JP] Japan ..... 10-059395

[51] Int. Cl.[7] ..... G03G 15/08

[52] U.S. Cl. ..... 399/262

[58] Field of Search ..... 399/111, 262, 399/263; 347/86, 214; 156/60, 94, 325, 326, 327, 329, 330, 338

[56] References Cited

U.S. PATENT DOCUMENTS 5,623,328 4/1997 Tsuda et al. ..... 399/111

FOREIGN PATENT DOCUMENTS 3-38671 2/1991 Japan .

*Primary Examiner*—William Royer
*Assistant Examiner*—Hoang Ngo
*Attorney, Agent, or Firm*—Wenderoth, Lind & Ponack, L.L.P.

[57] ABSTRACT

A toner cartridge includes a housing having a space for toner, and a cover forming a toner storing space within the housing. The cover is secured to the housing with an expandable hot-melt elastic adhesive to prevent toner leakage. This arrangement improves assembly of the cartridge, and allows the discarded cartridges to be recycled.

19 Claims, 9 Drawing Sheets

TONER CARTRIDGE SEALED BY EXPANDABLE HOT-MELT ELASTIC ADHESIVE

FIELD OF THE INVENTION

The present invention relates to toner cartridges employed in electrophotographic recording apparatuses such as electronic copiers, laser printers and facsimilie machines.

BACKGROUND OF THE INVENTION

Dry toner has been mainly used in image forming apparatuses such as copiers and laser printers, which are prevalent in the market. These image forming apparatuses employ electrophotographic-processes (i.e., an electrostatic latent image formed on a photosensitive plate including a photosensitive layer is developed with toner grains). An image forming apparatus that uses toner only for a developer has a toner cartridge, which comprises a toner hopper for accommodating toner, and a toner-fine-layer-forming-section that forms a fine layer of tribo-electrically charged toner on a developer roll.

The toner in this toner hopper is supplied to a toner-replenishing-roll by a toner transporting member. The supplied toner is transported to the developer roller with friction between the developer roll and the toner roll. The toner, which arrives at the developer roll, is charged by friction between the developer roll and a doctor blade, and thereby forms a fine layer on the developer roll. Part of the fine layer is consumed to develop an electrostatic latent image formed on the photosensitive plate, and the remaining toner is returned to the hopper via a PET (polyethylene terephtalate) sheet and the developer roll.

The toner flow thus generally falls into three categories, i.e., (1) circulating within the hopper to prevent the toner from being solidified, (2) developing electrostatic latent images, and (3) unused toner for the developing. The grain size of nonmagnetic toner filled in the cartridge ranges from ca. 2 $\mu$m to 16 $\mu$m. Thus various preventive measures have been taken against spill and leakage of toner from the cartridge.

A conventional toner cartridge is described with reference to the accompanying drawings. FIG. 8 is a side view of an image forming apparatus having a conventional toner cartridge.

In FIG. 8, a photosensitive plate 1 comprises a metal belt made of aluminum and a fine film coated thereon. The fine film functions as a photosensitive receptor and is made of selenium (Se) or organic photocell (OPC). Photosensitive plate 1 is supported by rolls 2, 3 and 4 so that a vertically flat face is formed between rolls 2 and 3. A driving motor (not shown) rotates photosensitive plate 1 on rolls 2 and 3 in a direction shown by arrow "A".

Along the rolling face of photosensitive plate 1, several devices are disposed such as: charger 5; optical exposure system 6; toner cartridges 7B, 7Y 7M, and 7C; intermediate transfer unit 8; photosensitive plate cleaner 9; and decharger 10 in this order along the rolling direction indicated by the arrow "A". In toner cartridges 7B, 7Y, 7M and 7C, developers of respective colors including black (B), yellow (Y), magenta (M), and cyan (C) are stored. Charger 5 comprises charged wires 11 made of tungsten wires, shield plate 12 and grid plate 13 both made of metal plates. A high voltage is applied to charged wires 11 to produce corona discharge, thereby charging photosensitive plate 1 uniformly via grid plate 13.

An exposure-light-beam 14 of image data is emitted from exposure optical system 6. In a case of a laser printer, an exposure light beam 14 is controlled by signals from a host computer (not shown), whereby a plurality of electrostatic latent images, corresponding to the respective colors, are formed on photosensitive plate 1.

Toner cartridges 7B, 7Y, 7M and 7C, corresponding to each color are detachably mounted vertically in this order from top to bottom in a given storage space provided in the apparatus. These cartridges have the same interior arrangement except they include different toners.

FIG. 9 is a perspective view of a conventional cartridge-housing 70 ready to be assembled.

FIG. 10 is a perspective view of a conventional cartridge-cover 71 ready to be assembled.

In FIG. 9, grooves 51*a*, 51*b* and 51*c* are formed on an upper part of side-walls of housing 70.

Sponges 52*a*, 52*b* and 52*c*, pasted with an adhesive agent (e.g., a double faced tape), adhere on grooves 51*a*, 51*b* and 51*c*. On the cover 71 shown in FIG. 10, ribs 53*a*, 53*b* and 53*c* are formed to engage with corresponding grooves 51*a*, 51*b* and 51*c*. Cover 71 is thus tightly mated to housing 70 with sponges 52*a*, 52*b* and 52*c*. Sponge 41 is provided to a toner supply opening in order to prevent the toner from leaking through a gap between the developer roll and cover 71.

In the prior art discussed above, sponges 52*a*, 52*b* and 52*c* are provided to the mating section in order to prevent toner leakage through a gap between housing 70 and cover 71. However, when the apparatus mounted with these cartridges is transported, or when these cartridges are transported independently as supply cartridges, leakage or spillage of toner from the cartridge is still sometimes found due to vibration accompanying the transportation. This happens because the grain sizes of toner ranges from 2 $\mu$m to 16 $\mu$m (i.e., they are ultra-fine particles when only a non-magnetic material is used).

Installation of pasting sponges 52*a*, 52*b* and 52*c* is cumbersome and time-consuming, because it requires peeling off a release paper from a slip of double-faced tape, and pasting the tape onto narrow grooves 51*a*, 51*b* and 51*c*. This process has significantly lowered operation efficiency.

After the toner cartridges 7B, 7Y, 7M and 7C are replaced, they are supposed to be recycled. Although reusable materials and components are used in the cartridge, the sponges 52*a*, 52*b* and 52*c* with the double-faced tape must be removed. Even when removal is tried, the sponges fray. It is therefore hard to remove the sponges completely from the cartridge and that the discarded cartridge is difficult to be reclaimed. Thus, recycling of the cartridge is hard.

SUMMARY OF THE INVENTION

The present invention addresses the problems discussed above, and aims at providing a toner cartridge free from toner leakage, easy to assemble, and easy to sort out when discarded for recycling.

The toner cartridge of the present invention comprises the following elements:

a housing having a space for accommodating toner; and a cover forming a toner storage space together with the housing.

The cover tightly closes the housing with an expandable hot-melt elastic adhesive. This arrangement allows an automatic injector to apply the expandable hot-melt elastic adhesive to the cartridge, and thereby eliminates the pasting of sponges and allows for an automated process.

Due to the characteristics of the expandable hot-melt elastic adhesive, the adhesive can be applied to or injected into parts and gaps of every possible shape to form a highly tight bond. Excellent release properties of this adhesive permit a user to remove the applied adhesive so that discarded cartridges can be easily sorted out for recycling.

DESCRIPTION OF THE PREFERRED EMBODIMENT

An exemplary embodiment is described hereinafter with reference to the accompanying drawings. Elements used in the conventional apparatus are denoted with the same symbols and detailed descriptions thereof are omitted.

Figure 2:
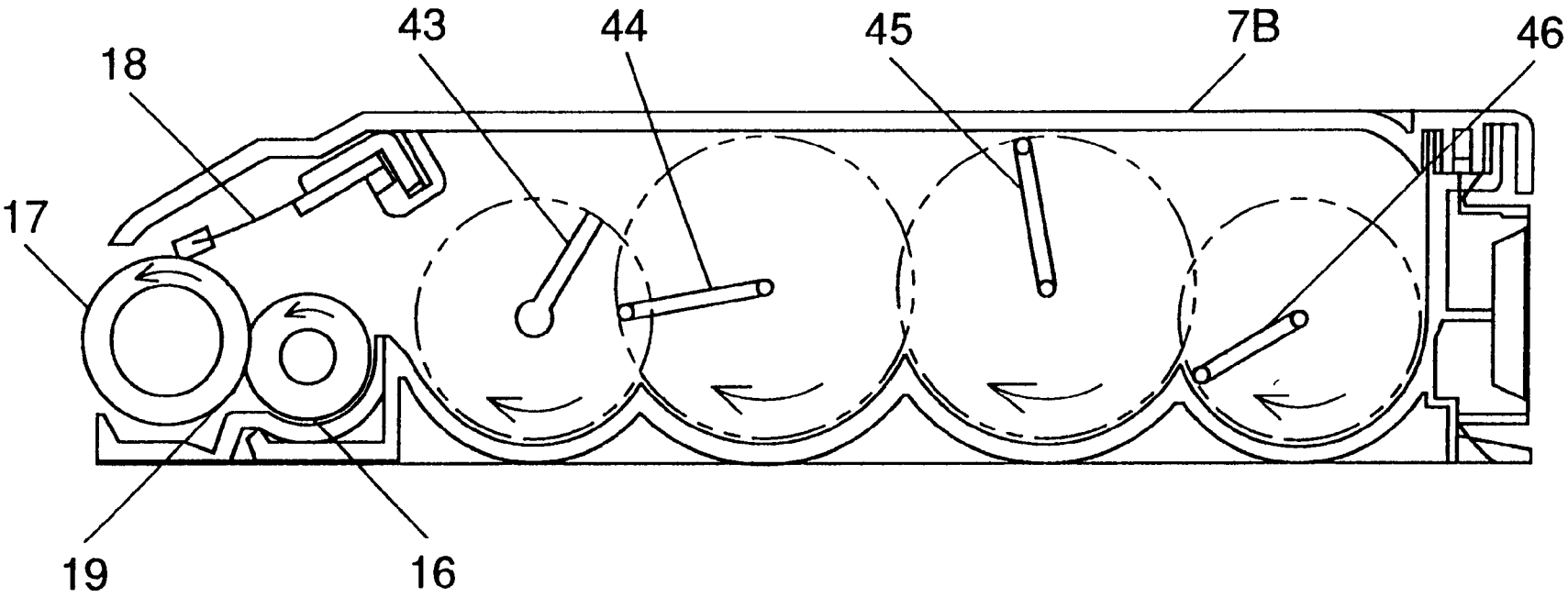
FIG. 2 is a side view of the toner cartridge in accordance with the exemplary embodiment of the present invention.
Figure 3:
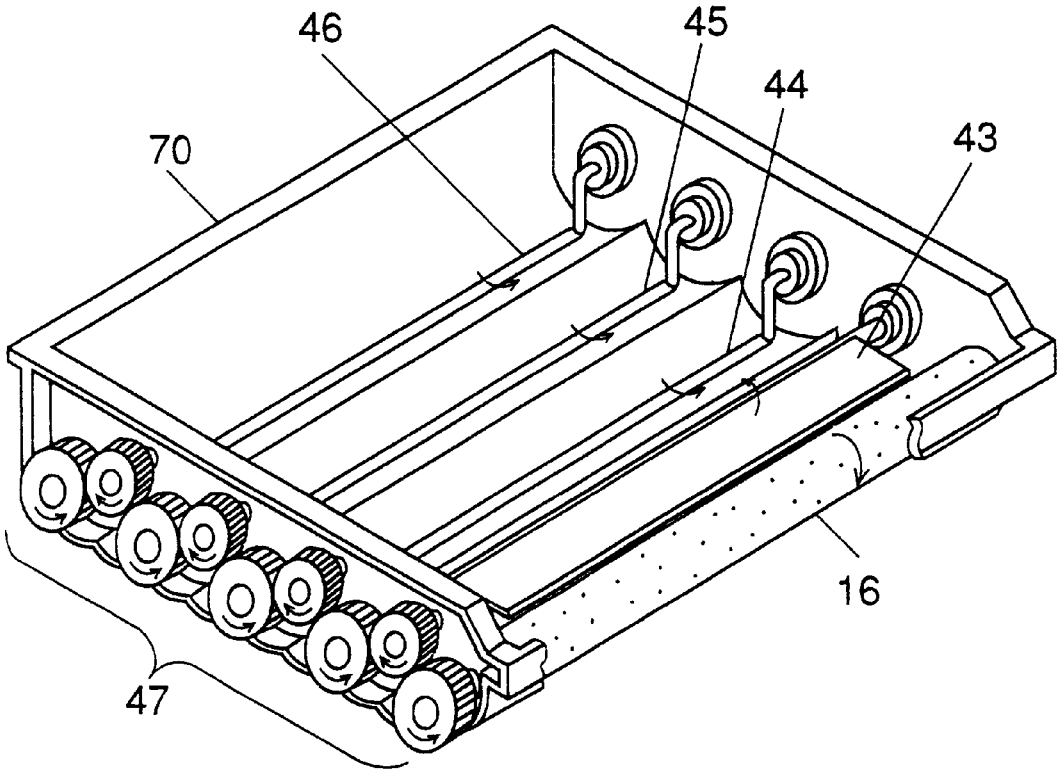
FIG. 3 is a perspective view of the toner cartridge in accordance with the exemplary embodiment of the present invention.

In FIG. 2 and FIG. 3, agitator 43 rotates in a circle shown in phantom along with a rotation of toner replenishing roll 16. Agitator 43 agitates the toner in cartridge 7B to avoid solidifying the toner and to transfer the toner to roll 16. A flat face of an agitator blade transports the toner and is integrally molded (in resin) with a shaft supporting agitator 43.

Agitators 44, 45 and 46 rotate in a circular loci shown in phantom in a clockwise direction. The agitators move the toner forward to the next agitator and agitates the toner to prevent solidifying of the toner. Agitator 46 forwards the toner to agitator 45, which forwards the toner to agitator 44, which then forwards the toner to agitator 43 sequentially.

Respective blades of agitators 44, 45 and 46 can have flat faces or can be wire-like. The blade preferably has the flat face in view of promoting circulation of the toner in the cartridge. However, the flat face sometimes increases rotary torque load on the agitator when the toner is unevenly distributed in one side of the cartridge 7B due to transportation. A series of agitator driving gears then 47 can be locked or dislodged due to this unevenly distributed toner.

Figure 1:
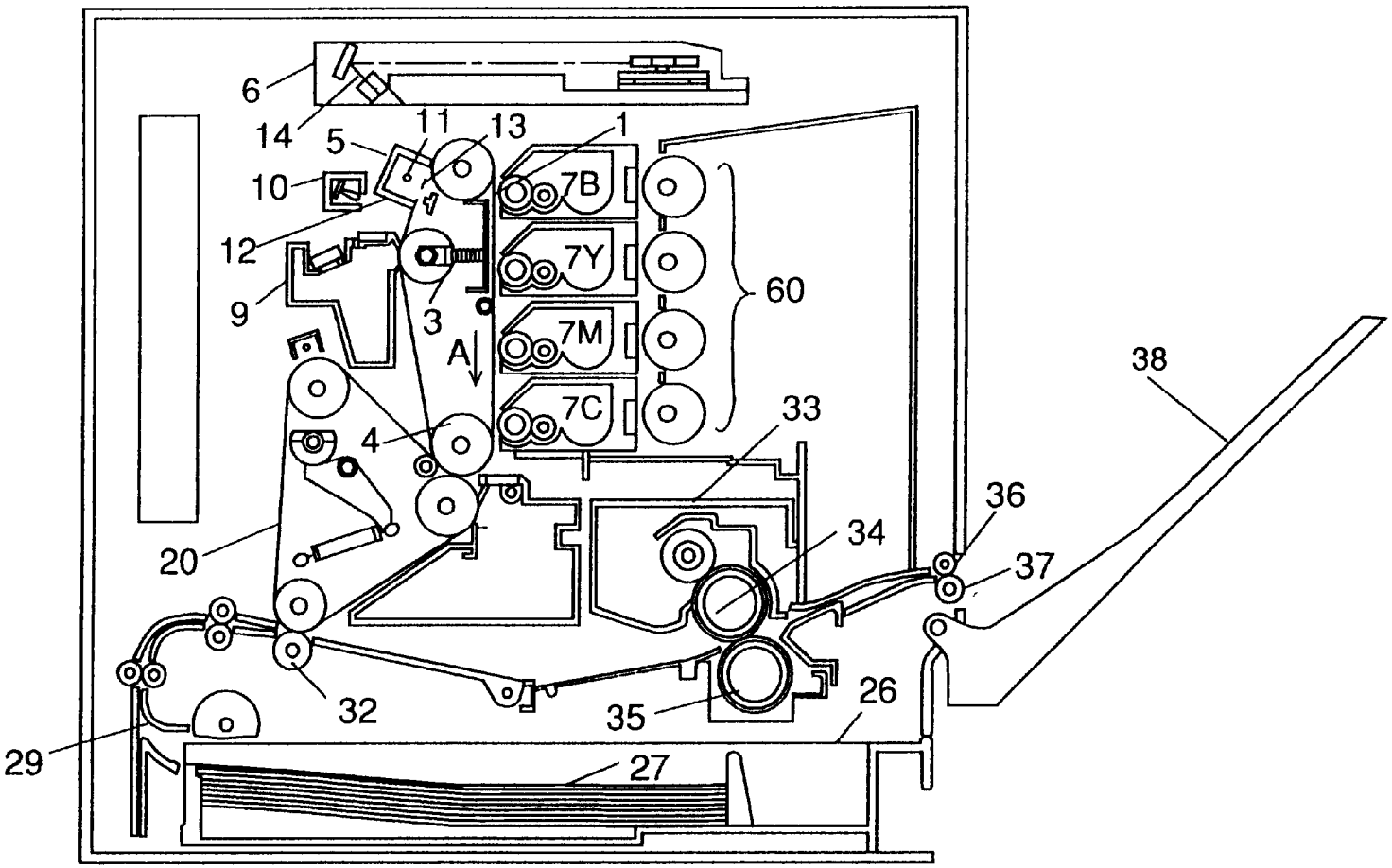
FIG. 1 is a side view of an image forming apparatus having a toner cartridge in accordance with an exemplary embodiment of the present invention.

Operation of this exemplary embodiment is described hereinafter. In FIG. 1, a high voltage is applied to charged wire 11 in charger 5 so that a corona discharge occurs and charges a surface photosensitive plate 1 uniformly at a voltage ranging from −500 V to −650 V.

Next, photosensitive plate 1 is rotated by a rotating device (not shown) in a direction shown by arrow A. Then, a given exposure-light-beam 14, such as a laser beam, radiates a color on the given color image (e.g., black (B)) to the surface of photosensitive plate 1. On the radiated portion of photosensitive plate 1, the given exposure-light-beam 14 cancels the electrical charge, and produces an electrostatic latent image.

Release and contact means 60 receives a color-selecting-signal from a host computer (not shown), and causes the toner cartridge 7B to contact photosensitive plate 1. Toner cartridge 7B stores black developer, which contributes to developing an image.

At this moment, the toner is forwarded to toner replenishing roll 16 by agitator 43 in cartridge 7B. The forwarded toner is tribo-electrically charged due to contact between the roll 16 and developer roll 17. The toner is affixed to the surface of roll 17 by electrostatic force. The toner layer affixed to the surface of the developer roll 17 is transported to doctor blade 18 by the rotation of roll 17. Friction between developer roll 17 and doctor blade 18 increases the tribo-electrical charge so that a fine and flat toner layer is formed.

The toner from doctor blade 18 forms a fine layer and retains the tribo-electrical charge. The toner is transported to an interface with photosensitive plate 1 (i.e., developing section). At this interface, a voltage is applied between developer roll 17 and photosensitive plate 1 while the toner layer contacts plate 1. Then, the toner is transferred to the electrostatic latent image formed on photosensitive plate 1 and is affixed to the photosensitive plate 1 to form a visible image. Thus, the developing process is completed.

The toner, which is not transferred to photosensitive plate 1, passes through a clearance between recovery sheet 19 and developer roll 17. The toner is scraped off by toner replenishing roller 16, and thereby returns to the cartridge 7B. Toner cartridge 7B after the developing is moved away from photosensitive plate 1 by a releasing contact means 60. When cartridge 7B engages in developing, the other cartridges 7Y, 7M, and 7C stay away from the photosensitive plate 1.

When the cyan color is selected next, toner cartridge 7C contacts with photosensitive plate 1 and starts developing a cyan image. As such, a copier or a printer using four colors repeats the developing process four times sequentially, and overlays the four colors (black, cyan, magenta and yellow) on an intermediate transfer belt 20 to form a composite image.

A sheet of paper 27 is transported along a paper transportation route 29 from a paper cassette 26. The formed composite image is transferred in one shot onto the sheet of paper 27 by a paper transfer roll 32 to which a high voltage is applied. The paper 27 is then transported to a fixer 33 where the paper 27 is heated and pinched by heat roll 34 and press roll 35. Thus, a color image is formed. Paper 27 then passes through a pair of discharge rolls 36 and 37, and is discharged onto tray 38.

A way of assembling toner cartridges 7B, 7Y, 7M and 7C is described below.

Figure 4:
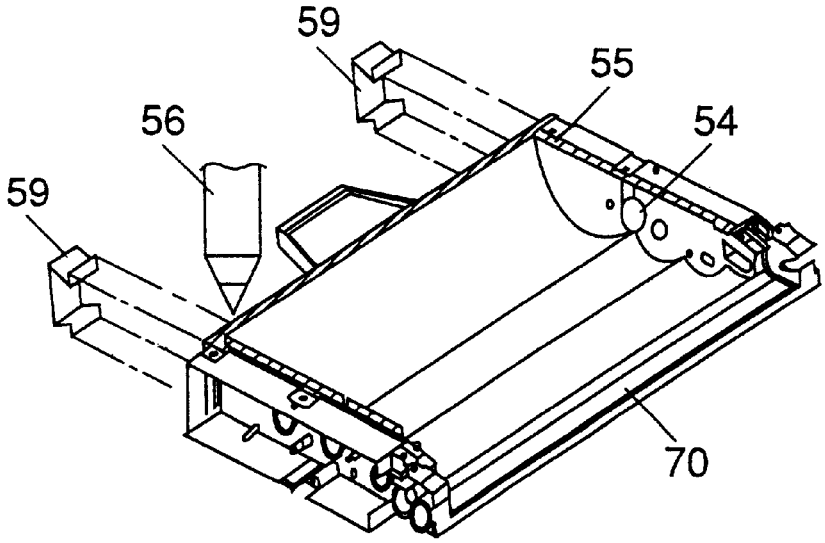
FIG. 4 is a perspective view depicting an application of expandable hot-melt elastic adhesive by an automatic injector onto a mating section of a cartridge-housing, in accordance with the exemplary embodiment of the present invention.
Figure 5:
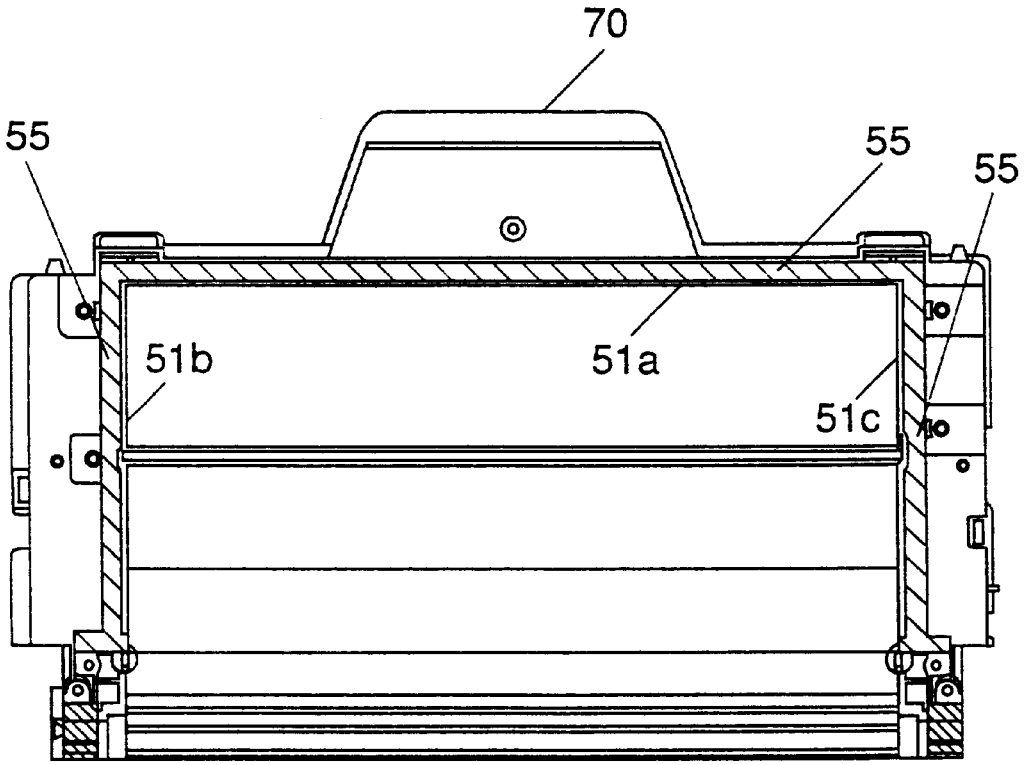
FIG. 5 is a top view of the cartridge-housing, in accordance with the exemplary embodiment of the present invention, to which the expandable hot-melt elastic adhesive solvent is applied.
Figure 6:
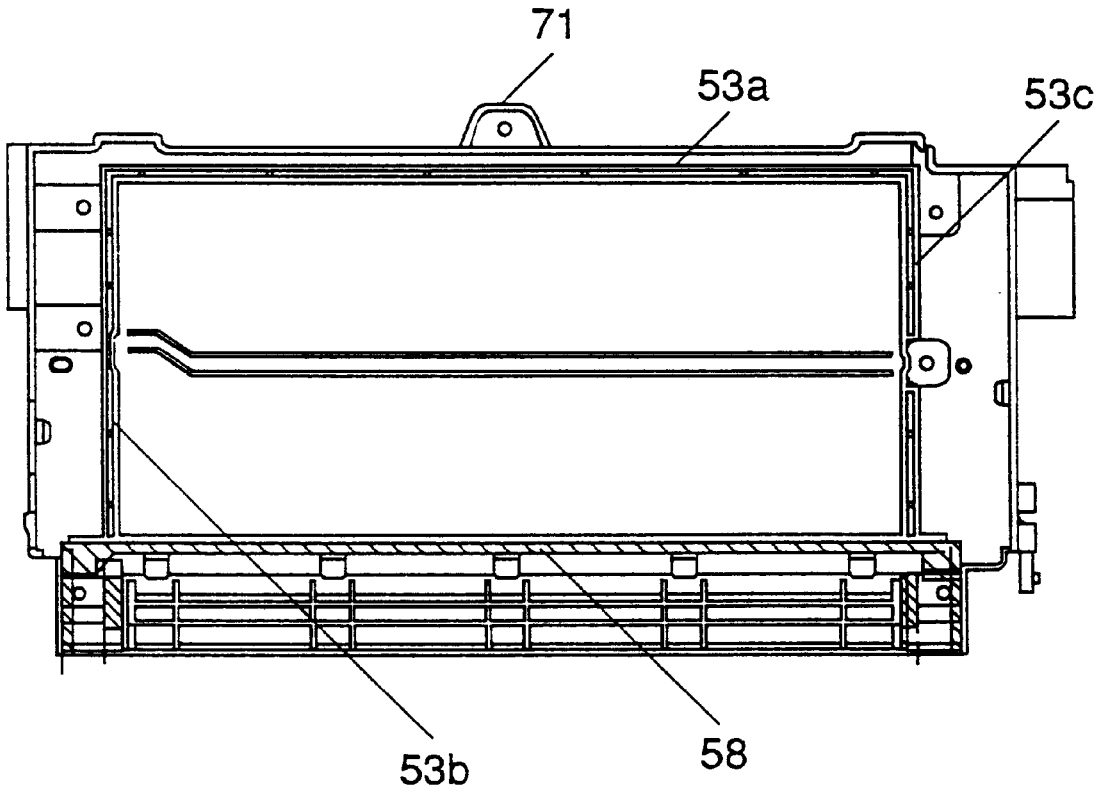
FIG. 6 is an inside view of a cartridge-cover in accordance with the present invention.
Figure 7:
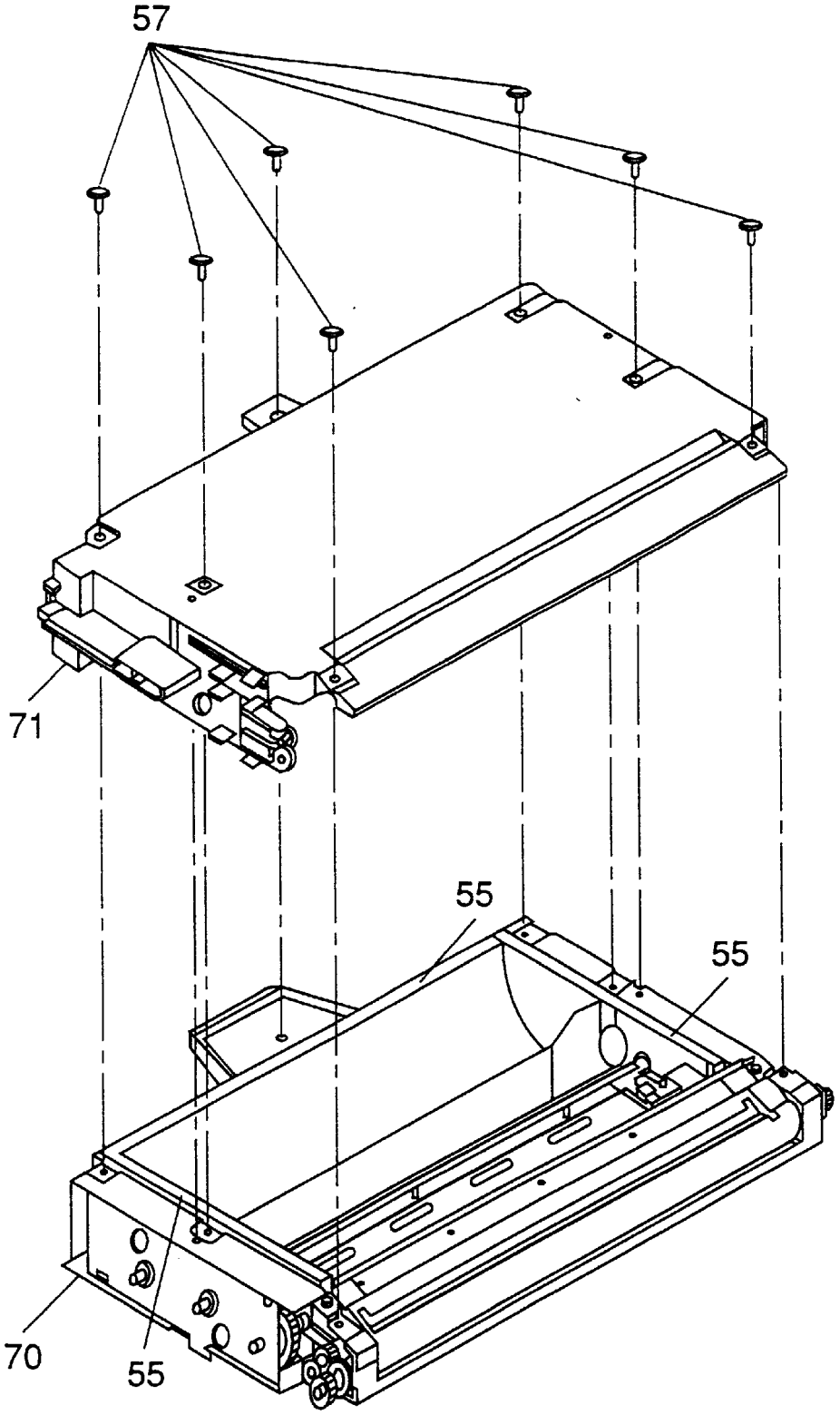
FIG. 7 depicts assembly of the toner cartridge in accordance with the exemplary embodiment of the present invention.
Figure 8:
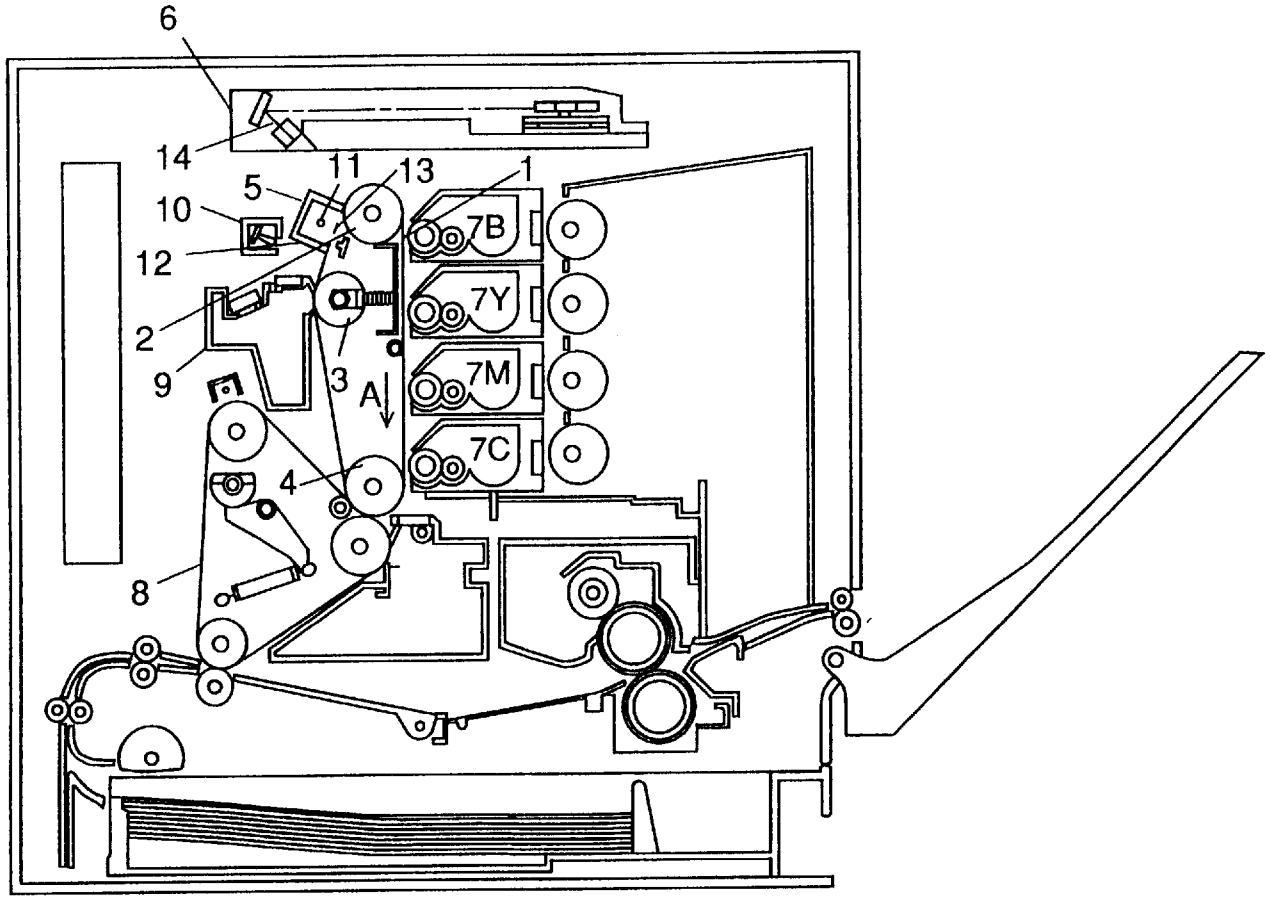
FIG.8 PRIOR ART
FIG. 8 is a side view of a conventional image forming apparatus having a toner cartridge.
Figure 9:
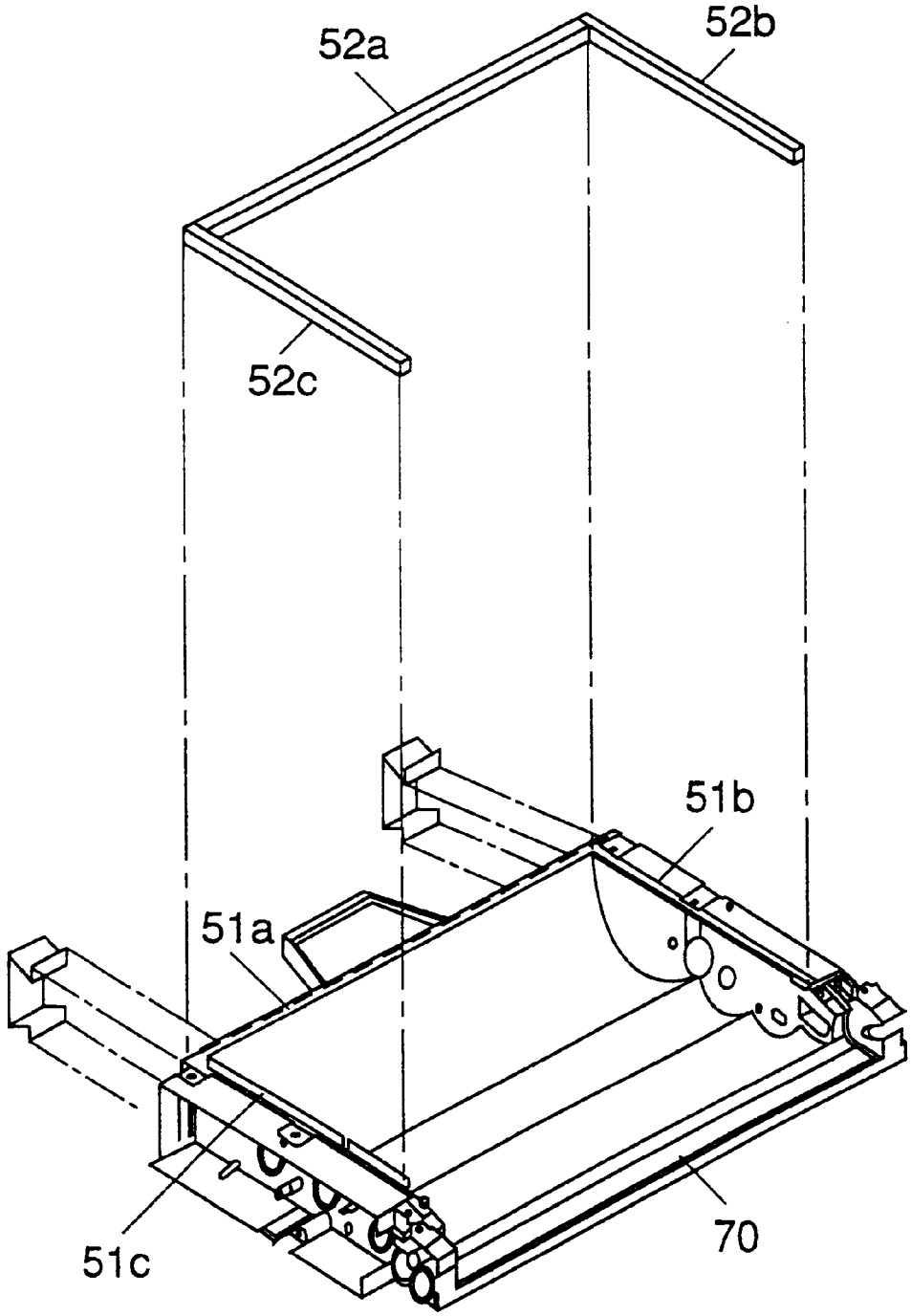
FIG.9 PRIOR ART
FIG. 9 is a perspective view depicting assembly of the conventional toner cartridge having a storage space for toner.

FIG. 4 is a perspective view depicting an application of expandable hot-melt elastic adhesive by an automatic injector to a mating section of a cartridge-housing 70 (which has a toner hopper where toner is filled). FIG. 5 is a top view of a cartridge-housing 70, to which the expandable hot-melt elastic adhesive is applied. FIG. 6 is an inside view of a cartridge-cover 71. FIG. 7 depicts assembly of the housing 70 and the cover 71 of the toner cartridge.

In FIG. 4, a toner hopper for accommodating toner is formed in the housing 70. A bottom of the hopper is shaped like a series of arcs to allow the rotation of agitators 43–46. The toner is stored in a space surrounded by a rear wall and two side-walls. The toner is supplied from the front (hopper-front) where the developer roll 17 is rotatably mounted. Opening 54 is provided on one of the side-walls of housing 70 so as that toner can be filled through the opening 54 after the cartridge is assembled. After the toner is filled, the opening 54 is sealed. Elastic members 59 move the toner cartridges 7B, 7Y, 7M and 7C back and forth to make contact with photosensitive plate 1. Elastic members 59 move the cartridges away from the plate 1 by using release and contact means 60 (e.g., a cam member).

In FIG. 5, grooves 51*a*, 51*b* and 51*c* are continuously formed on an upper face of the three walls discussed above. In FIG. 6, ribs 53*a*, 53*b* and 53*c* are formed on the cover 71 to engage with respective grooves 51*a*, 51*b* and 51*c*. Cover 71 is mated with the housing 70 so that ribs 53*a*, 53*b*, and 53*c* are inserted into grooves 51*a*, 51*b* and 51*c*, whereby toner cartridges 7B, 7Y, 7M and 7C are assembled.

This assembly method is further discussed in detail below. As shown in FIG. 4, heated and expanded hot-melt elastic adhesive 55 is injected in the grooves 51*a*, 51*b*, and 51*c* formed on the upper part of the side walls of housing 70. In this embodiment, an automatic injector 56 (made by Nordson Inc., under a brand name FOAM MELT) is employed to inject the hot-melt elastic adhesive 55. To be more specific, gas and the hot-melt elastic adhesive 55 is agitated, and then mixed and melted by applying pressure within automatic injector 56. When the adhesive 55 is discharged from the automatic injection 56, a gas is mixed and expanded to form numerous fine bubbles. This forms expandable hot-melt elastic adhesive 55, which is injected into the grooves 51*a*, 51*b*, and 51*c*.

As shown in FIG. 7, the ribs 53*a*, 53*b*, and 53*c* are inserted into the grooves 51*a*, 51*b* and 51*c*, where the expandable hot-melt elastic adhesive 55 is applied, so that the cover 71 is closely mated with the housing 70. Further, screws 57 tightly secure the cover 71 to the housing 70.

The performance of expandable hot-melt elastic adhesive 55 is discussed below. In the exemplary embodiment, EVER-GRIP AS992-1 (made by AC & Japan Ltd.) is employed as the adhesive 55. This adhesive 55 is mainly comprised of a synthetic rubber, and has the following properties: a softening point=120° C. (R&B method); a melt viscosity=28600 cps. at 160° C.; 7900 cps. at 180° C.; and 3100 cps at 200° C. (measured by a brook-field viscometer with a thermocell). The expandable hot-melt elastic adhesive 55 is discharged into the air and increases its volume greater than a conventional hot-melt adhesive. A given amount of the expandable hot-melt elastic adhesive 55 applied to fitting members can effectively seal gaps.

This increasing volume rate (i.e., expansion rate) should be high enough to secure the cover 71 to the housing 70 and to prevent toner leakage.

Preferably the expansion rate ranges from 2 to 4.5. If the rate is less than 2, insufficient expansion makes the adhesive 55 hard. If the rate is over 4.5, the adhesive 55 expands too much. The gas pressure for expansion thus exceeds the surface tension of the hot-melt, and the gas is vented. As a result, no expansion is produced. Therefore, the resultant low elasticity makes the adhesive 55 hard and provides little sealing effect, whereby the cover 71 cannot be secured to the housing 70 and toner is leaked.

When the expansion rate is kept between 3 and 3.5, the adhesive 55 can not only solve the problems discussed above, but also prevents the toner leakage for a long period of time.

Figure 10:
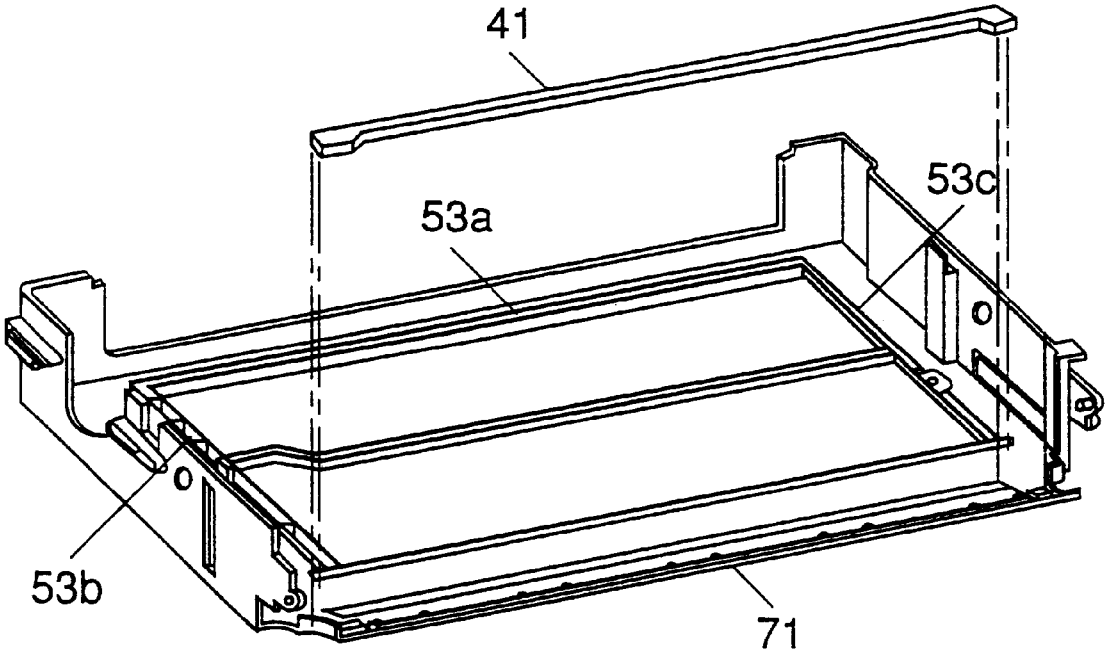
FIG.10 PRIOR ART
FIG. 10 is a perspective view of a conventional cartridge-cover ready to be assembled.

In the exemplary embodiment, the expandable hot-melt elastic adhesive 55 is injected into only the grooves 51*a*, 51*b* and 51*c* in the housing 70. The cover 71 is mated to the housing 70. The adhesive 55 can be applied to the mating sections for both the housing 70 and cover 71. Sponges 41 used in the prior art shown in FIG. 10 can be replaced with the expandable hot-melt elastic adhesive 58 used in this embodiment shown in FIG. 6 and the adhesive 58 can have greater performance than the sponges 41. The adhesive 55 can be applied to possible places where toner can leak. The characteristics of the expandable hot-melt elastic adhesive 55 allow the operators to apply it to any sections and gaps of every possible shape with a high sealing capability.

Grooves in the housing 70 or the cover 71 make it easy to remove the adhesive solvent for recycling, because the grooves are formed continuously.

As discussed above, the present invention improves the assembly of the toner cartridge, and allows the housing and cover of the cartridge to be tightly sealed. An automatic injector 56 can inject the adhesive 55, thereby improving assembly efficiency. Further, the adhesive 55 can be removed easily when the cartridge is sorted for reclaiming and recycling. Therefore, the present invention provides an advantage that discarded components of the toner cartridge can be easily recycled.

What is claimed is:

1. A toner cartridge comprising:

a housing having a toner hopper formed therein;

a cover secured to said housing so as to form a toner storing space with said toner hopper of said housing; and an expandable hot-melt elastic adhesive securing said cover to said housing, said expandable hot-melt elastic adhesive having an expansion rate ranging from 2 to 4.5.

2. The toner cartridge of claim 1, wherein said expansion rate of said expandable hot-melt elastic adhesive ranges from 3 to 3.5.

3. A toner cartridge comprising:

a housing having a toner hopper formed therein and including a housing mating section;

a cover secured to said housing so as to form a toner storing space with said toner hopper of said housing, said cover including a cover mating section that is mated with said housing mating section;

a groove provided on only one of said housing mating section and said cover mating section;

an expandable hot-melt elastic adhesive provided in said groove; and wherein said cover is secured to said housing by said expandable hot-melt elastic adhesive.

4. The toner cartridge of claim 3, wherein said groove is continuously formed about a periphery of said one of said housing mating section and said cover mating section.

5. The toner cartridge of claim 4, wherein said expandable hot-melt elastic adhesive has an expansion rate high enough to secure said cover to said housing and to prevent toner leakage.

6. The toner cartridge of claim 4, wherein said expandable hot-melt elastic adhesive has an expansion rate ranging from 2 to 4.5.

7. The toner cartridge of claim 4, wherein said expandable hot-melt elastic adhesive has an expansion rate ranging from 3 to 3.5.

8. The toner cartridge of claim 3, wherein said expandable hot-melt elastic adhesive has an expansion rate high enough to secure said cover to said housing and to prevent toner leakage.

9. The toner cartridge of claim 3, wherein said expandable hot-melt elastic adhesive has an expansion rate ranging from 2 to 4.5.

10. The toner cartridge of claim 3, wherein said expandable hot-melt elastic adhesive has an expansion rate ranging from 3 to 3.5.

11. The toner cartridge of claim 3, wherein said groove is partly filled with said hot-melt elastic adhesive.

12. The toner cartridge of claim 3, wherein said groove is entirely filled with said hot-melt elastic adhesive.

13. A toner cartridge comprising:

a housing having a toner hopper formed therein and including a housing mating section;

a cover secured to said housing so as to form a toner storing space with said toner hopper of said housing, said cover including a cover mating section that is mated with said housing mating section;

a groove provided on one of said housing mating section and said cover mating section;

a rib provided on the other of said housing mating section and said cover mating section, said rib engaging said groove;

an expandable hot-melt elastic adhesive provided in said groove; and wherein said cover is secured to said housing by said expandable hot-melt elastic adhesive.

14. The toner cartridge of claim 13, wherein said groove is continuously formed about a periphery of said one of said housing mating section and said cover mating section.

15. The toner cartridge of claim 13, wherein said expandable hot-melt elastic adhesive has an expansion rate high enough to secure said cover to said housing and to prevent toner leakage.

16. The toner cartridge of claim 13, wherein said expandable hot-melt elastic adhesive has an expansion rate ranging from 2 to 4.5.

17. The toner cartridge of claim 13, wherein said expandable hot-melt elastic adhesive has an expansion rate ranging from 3 to 3.5.

18. The toner cartridge of claim 13, wherein said groove is partly filled with said hot-melt elastic adhesive.

19. The toner cartridge of claim 13, wherein said groove is entirely filled with said hot-melt elastic adhesive.

* * * * *